US012392102B2

(12) United States Patent
Seifert et al.

(10) Patent No.: US 12,392,102 B2
(45) Date of Patent: Aug. 19, 2025

(54) CONSTRUCTION MACHINE, DISPLACEMENT TUBE AND METHOD FOR CREATING A FILLING MATERIAL COLUMN IN THE GROUND

(71) Applicant: BAUER Spezialtiefbau GmbH, Schrobenhausen (DE)

(72) Inventors: Michael Seifert, Barleben (DE); Bernhard Karmann, Ehekirchen-Seiboldsdorf (DE); Heiko Voigt, Döbeln (DE); Herbert Karl, Osterham (DE)

(73) Assignee: BAUER Spezialtiefbau GmbH, Schrobenhausen (DE)

( * ) Notice: Subject to any disclaimer, the term of this patent is extended or adjusted under 35 U.S.C. 154(b) by 197 days.

(21) Appl. No.: 18/263,484

(22) PCT Filed: Mar. 14, 2022

(86) PCT No.: PCT/EP2022/056484
§ 371 (c)(1),
(2) Date: Jul. 28, 2023

(87) PCT Pub. No.: WO2022/200096
PCT Pub. Date: Sep. 29, 2022

(65) Prior Publication Data

US 2024/0084540 A1 Mar. 14, 2024

(30) Foreign Application Priority Data

Mar. 24, 2021 (EP) ..... 21164548

(51) Int. Cl.
*E02D 5/38* (2006.01)
*E02D 5/66* (2006.01)

(52) U.S. Cl.
CPC ..... *E02D 5/385* (2013.01); *E02D 5/665* (2013.01); *E02D 2200/1685* (2013.01); *E02D 2250/0007* (2013.01); *E02D 2250/003* (2013.01)

(58) Field of Classification Search
CPC . E02D 5/385; E02D 5/665; E02D 2200/1685; E02D 2250/0007; E02D 2250/003
See application file for complete search history.

(56) References Cited

U.S. PATENT DOCUMENTS 9,816,245 B2 * 11/2017 Reinhardt ..... E02D 3/08

FOREIGN PATENT DOCUMENTS

DE 296 11 427 U1 9/1996
DE 103 10 727 B4 9/2007
(Continued)

OTHER PUBLICATIONS

International Search Report issued in PCT/EP2022/056484; mailed May 11, 2022.

(Continued)

*Primary Examiner* — Kyle Armstrong
(74) *Attorney, Agent, or Firm* — Studebaker Brackett PLLC

(57) ABSTRACT

The invention relates to a construction machine for introducing a displacement tube into the ground, wherein the displacement tube comprises a tube base body and, at its lower end, a closure device which comprises at least one closure flap which is adjustable between a closed position, in which the displacement tube is closed downwards by the at least one closure flap, and an open position, in which filling material is discharged from the displacement tube into the ground for forming a filling material column, wherein the construction machine comprises a feed drive for introducing and retracting the displacement tube into and out of (Continued)

Figure 1:
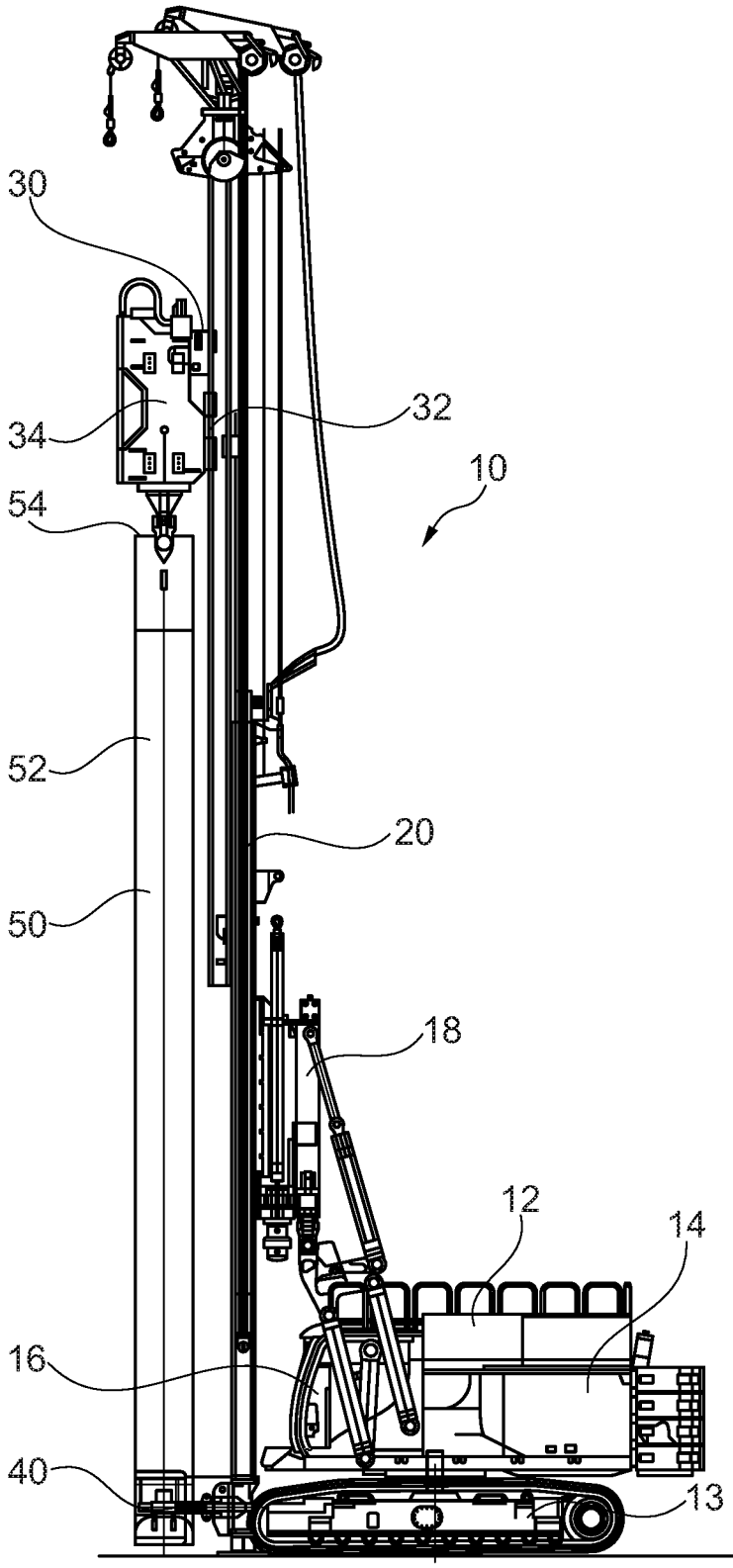

the ground, respectively. According to the invention, it is provided that an actuating unit with at least one pressing-on element is arranged on the construction machine, by means of which the at least one closure flap is adjustable from the open position into its closed position and retainable in said position before contacting the ground at least until the closed closure flap penetrates into the ground. The invention further relates to a method for creating a filling material column.

13 Claims, 2 Drawing Sheets

(56) References Cited

FOREIGN PATENT DOCUMENTS

| | | | |
|---|---|---|---|
| DE | 20 2020 105 037 | U1 | 9/2020 |
| EP | 3 112 535 | A1 | 1/2017 |
| EP | 3192927 | A1 * | 7/2017 |
| EP | 3 192 927 | B1 | 4/2019 |
| GB | 2 311 083 | A | 9/1997 |
| NL | 2005298 | C2 * | 3/2012 |

OTHER PUBLICATIONS

International Preliminary Report on Patentability (Chapter II) issued in PCT/EP2022/056484; completed Jul. 20, 2023.

* cited by examiner

CONSTRUCTION MACHINE, DISPLACEMENT TUBE AND METHOD FOR CREATING A FILLING MATERIAL COLUMN IN THE GROUND

The invention relates to a construction machine for introducing a displacement tube into the ground, the displacement tube having a tube base body and, at its lower end, a closure device which comprises at least one closure flap which is adjustable between a closed position, in which the displacement tube is closed downwards by the at least one closure flap, and an open position in which filling material can exit the displacement tube into the ground for forming a filling material column, wherein the construction machine comprises a feed drive for introducing and retracting the displacement tube into and out of the ground, respectively, according to the preamble of claim 1.

The invention further relates to a displacement tube for creating a filling material column in the ground, wherein the displacement tube can be introduced into the ground by means of a construction machine according to the invention and the displacement tube has a tube base body and, at its lower end, a closure device which comprises at least one closure flap, which is adjustable between a closed position, in which the displacement tube is closed downwardly by the at least one closure flap, and an open position, in which filling material for forming a filling material column can exit the displacement tube into the ground, according to the preamble of claim 8.

The invention further relates to a method for creating a filling material column in the ground, in which a displacement tube with a closure device having at least one closure flap is introduced into the ground, which flap is in a closed position during introduction, and when a final depth is reached, the at least one closure flap is pivoted from the closed position into an open position, wherein filling material is introduced into the ground through an outlet opening to form the filling material column, according to the preamble of claim 12.

EP 3 192 927 B1 or DE 103 10 727 B4 discloses displacement tube and a method for creating a filling material column in the ground. The displacement tube is driven into a soft, displaceable ground, for example by means of a vibrator on a construction machine. Concrete, lime, gravel, sand, crushed stone or dry mortar, for example, can be introduced into the ground via the displacement tube. In the process, essentially vertical filling material columns are created, through which the subground is stabilized and strengthened. These columns usually extend as far as to a load-bearing ground layer that can absorb higher vertical forces. The filling material columns can be used, for example, for the foundation of a building.

The known displacement tubes have a closure device on their underside, usually with two closure flaps which form a penetration tip in their closed position. The closure flaps are supported on a tube base body in a freely pivotable manner. For this purpose, they are usually hinged in such a way that the closure flaps are close to their closed position in an unloaded state. Placing the displacement tube on the ground and further pressing the displacement tube into the ground usually causes the closure flaps to close completely, thus introducing the displacement tube in the closed position into the ground to a desired final depth. When the final position is reached, filling material can then be introduced into the displacement tube from above. When the displacement tube is pulled back, the closure flaps are pressed open by the filling material being present into their open position, so that the filling material can exit the displacement tube into the ground for forming the filling material column.

In certain ground conditions, it is possible that the closure flaps do not close completely, or at least not completely immediately, when the displacement tube is introduced into the ground. If the closure flaps are not fully closed, ground material may enter the displacement tube during the introduction phase. During subsequent filling of the filling material, ground material can contaminate the filling material in an undesired way. The filling material column produced then does not consist entirely of the filling material. This can have negative effects on the bearing capacity of the column produced in the ground and thus on the foundation of the structure.

It is known from DE 20 2020 105 037 U1 that an additional pressure flap is mounted on the outside of the closure flap, which applies additional closing forces to the closure flap when it is pressed into the ground. However, this additional pressure flap presents additional resistance when introducing the displacement tube into the ground and increases a necessary cleaning and maintenance effort of the displacement tube. In addition, under certain ground conditions, it may take some time for the closure flaps to fully closed during ground penetration, so that ground material could enter the displacement tube in an undesirable manner during this time period.

The object underlying the invention is to provide a construction machine, a displacement tube and a method by means of which a filling material column can be created in the ground with a displacement tube in a particularly efficient manner.

The object is achieved by a construction machine having the features of claim 1, a displacement tube having the features of claim 8, and a method having the features of claim 12. Preferred embodiments of the invention are indicated in the dependent claims.

The invention is characterized in that an actuating unit with at least one pressing-on element is arranged on the construction machine, by means of which the at least one closure flap is adjustable into its closed position and retainable in said position before contacting the ground, at least until the closed closure flap penetrates into the ground.

A basic idea of the invention is not rely on the reaction forces of the ground for closing the closure flap solely upon penetration of the displacement tube. Rather, the at least one closure flap is closed by a separate actuating unit with a pressing-on element before it penetrates the ground. Thereby, the pressing-on element is pressed against an outer side of the closure flap and thus the closure flaps are reliably adjusted into the closed position and held there until the further reaction forces of the ground when the displacement tube is pressed into the ground press the closure flap, which is usually of conical design, into its closed position.

The invention thus ensures that no, or at least no substantial, amount of ground material can enter the displacement tube, even in an initial phase. Thus, contamination of the filling material by entered ground material can be avoided. Thus, columns of filling material can be created in the ground in a high quality in a reliable manner.

A preferred embodiment of the invention is that the feed drive is vertically movable with the displacement tube along a mast and that the actuating unit is arranged at a lower end of the mast. The feed drive may in this case not solely comprise a drive for linear displacement of the displacement tube. In particular, the feed drive may comprise a vibrator or a pile driver by means of which the introducing or pressing of the displacement tube into the ground is facilitated. The displacement tube preferably has a downwardly tapering tip for penetration into the ground.

The actuating unit is arranged at a distance from the displacement tube, preferably at the lower end of the mast on the construction machine, so that the pressing-on element can be fed to the closure flap from the outside. In particular, the actuating unit can be mounted adjustably, preferably height-adjustably.

In principle, the actuating unit can be configured in any suitable manner, in order to effect a reliable closing of the at least one closure flap before it is introduced into the ground in a power-driven manner. According to a further development of the invention, it is particularly advantageous that the at least one drive element has an actuating arm which is adjustable, in particular, pivotable, between a pressing-on position for closing the closure flap and a retracted position in which the pressing-on element is spaced apart from the displacement tube and the at least one closure flap.

In this case, the actuating arm can be adjusted between the drive position and the retracted position by means of a hydraulic cylinder or other drive. The pressing-on element can here be designed in an arbitrary manner to come into temporary contact with the closure flap. The pressing-on element can hold the closure flap in its closed position until the closure flap is pressed further into its closed position and held in place by the contacting ground.

A particularly preferred variant according to the invention is that a pressure-on plate is attached to a free end of the actuating arm. This allows a pressure-on force to be transmitted over a larger area and/or ensures reliable contact with the closure flap over a larger area.

According to a further development of the invention, a particularly efficient introduction of the displacement tube into the ground is achieved in that the displacement tube comprising two closure flaps and that the actuating unit comprising two corresponding pressing-on elements, each of which is assigned to a closure flap. The two closure flaps are designed approximately half-shell-shaped and curved, so that they form a lower displacement tip of the displacement tube in their closed position.

In this case, the closure flaps are mounted opposite on the tube base body. They are actuated accordingly by two opposing pressing-on elements of the actuating unit, so that transverse forces cancel each other out and do not act on the displacement tube as a whole.

In principle, the invention can also comprise three, four or more closure flaps, each individual closure flap or groups of closure flaps being operable by means of an associated pressing-on element.

Another advantageous embodiment of the invention is that the pressure plates of the two pressing-on elements are arcuate and designed to apply and guide the displacement tube during further penetration into the ground. The pressing-on elements can thus fulfill a dual function. First, as described above, they can press and hold the closure flaps in their closed position until the displacement tube penetrates the ground. Subsequently, the pressing-on elements can be retracted from the displacement tube again and, after further penetration of the displacement tube into the ground, be applied to the displacement tube again in an area above the pivot joints of the closure flaps. The arcuate or approximately cylindrical half-shell-shaped design of the pressure-on plates allows the displacement tube to be closely abutted and guided on its outer side. In this way, the displacement tube can be additionally guided and thus introduced into the ground with particular positioning-accuracy and, in particular, with a high degree of verticality.

In principle, the actuating unit can be operated and controlled manually by an operator. For efficient operation of the construction machine, it is advantageous that a control means is provided by means of which the at least one pressing-on element is actuatable towards the at least one closure flap for closing the displacement tube before the at least one closure flap penetrates into the ground. The control means can thereby perform the adjustment of the pressing-on element automatically according to a predetermined program.

In particular, an infeed to the closure flaps can take place depending on the vertical position of the displacement tube. When the displacement tube moves down further, the pressing-on elements can then be automatically returned to their retracted position, in which the pressing-on elements are spaced apart from the closure flaps, and/or feed them to the tube base body for guidance.

Corresponding sensors can be provided on the construction machine to detect the position of the displacement tube and the closure flaps as well as the pressing-on elements, with the sensors being in communication with the control means.

The invention further comprises a displacement tube for creating a filling material column in the ground, the displacement tube being characterized in that a radially projecting actuating portion is formed on an outer side of the at least one closure flap, which portion is engageable with a pressing-on element of an actuating unit of the construction machine, wherein the closure flap can be pressed from the open position into the closed position by contact with the actuating portion.

The actuating unit in particular represents a contact element which can be brought into engagement with the pressing-on element of the construction machine described above. The displacement tube can, in particular, be used together with the construction machine described above.

According to the invention, an advantageous embodiment of the displacement tube is that the at least one closure flap is pivotably hinged to an outer side of the tube body by means of a pivot joint, and that the actuating portion on the closure flap is designed such that the actuating portion projects radially outwards with respect to the pivot joint both in the open position and in the closed position. This arrangement ensures that the pressing-on element is always reliably in contact with the actuating portion of the closure flap, not only in the open position but also when the closure flaps are pressed radially inwards.

In particular, in the closed position, the actuating portion continues to project radially outward relative to the pivot joint. The actuating portion can be arranged close to a pivot joint of the closure flap, preferably below the pivot axis.

In order to form a stable penetration tip on the displacement tube, it is advantageous according to a further development of the invention that the closure device comprises two closure flaps which are supported on the tube body. In this case, the closure flaps are pivotably hinged at opposite positions on the tube base body. In particular, they can each form half of the displacement tip when the two closure flaps are in their closed position.

According to a further development of the invention, it is also advantageous that a feed device for feeding the filling material is arranged at an upper end of the tube base body. In particular, the feed device can comprise a feed hopper. In particular, concrete, lime, gravel, sand, crushed stone or dry material can be provided as the filling material for forming the filling material column. The filling material is basically introduced into the displacement tube when the latter has been introduced into the ground up to the desired final depth. The filling material can also be surrounded by a geotextile or a film, especially if sand is introduced as filling material. The geotextile or film can be shaped like a bag and arranged in the displacement tube. When the displacement tube is retracted, the closure flaps are pushed outwards into their open position by the filling material present on the inside, so that the filling material can exit for forming the filling material column and fill the hole formed by the displacement.

When the displacement tube is retracted from the ground, it can perform an alternating upward/downward movement to achieve increased compaction of the placed filling material.

The method according to the invention is characterized in that by means of an actuating unit at least one pressing-on element is pressed against the at least one closure flap before a displacing contacting of the closure flap with the ground, wherein the at least one closure flap is adjusted from the open position into the closed position. The method can be performed, in particular, with a construction machine which has been described above and indicated in the claims.

The method can be used to achieve the previously described advantages when producing a filling material column in the ground.

A particularly preferred method variant of the method according to the invention is in that the at least one pressing-on element abuts the at least one closure flap until the latter penetrates into the ground and that the at least one pressing-on element is then retracted from the closure flap. During a further introduction of the displacement tube into the ground for forming a hole, the at least one pressing-on element can be placed against the tube base body for its further guidance.

According to a further embodiment of the invention, it is advantageous that the displacement tube is retracted from the ground and, during a retraction movement of the displacement tube, the at least one closure flap is adjusted into the open position. This is caused, in particular, by the pressure of the filling material in the displacement tube present from the inside.

Figure 2:
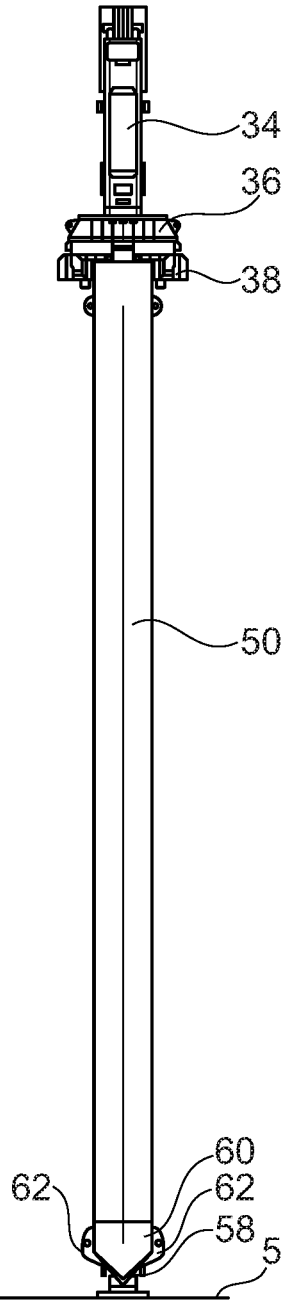
Figure 5:
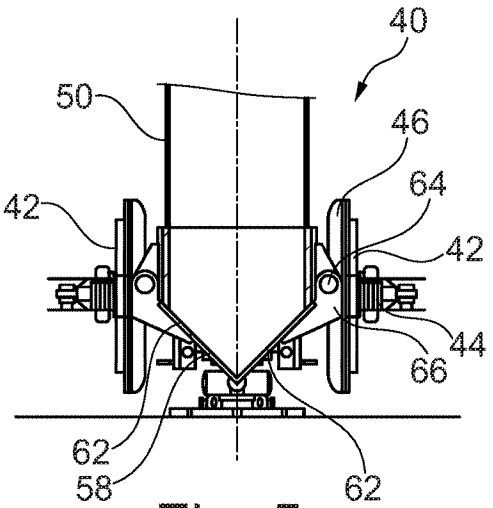
Figure 6:
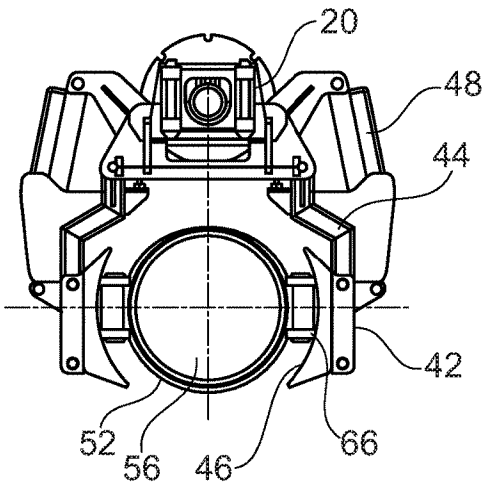
Figure 3:
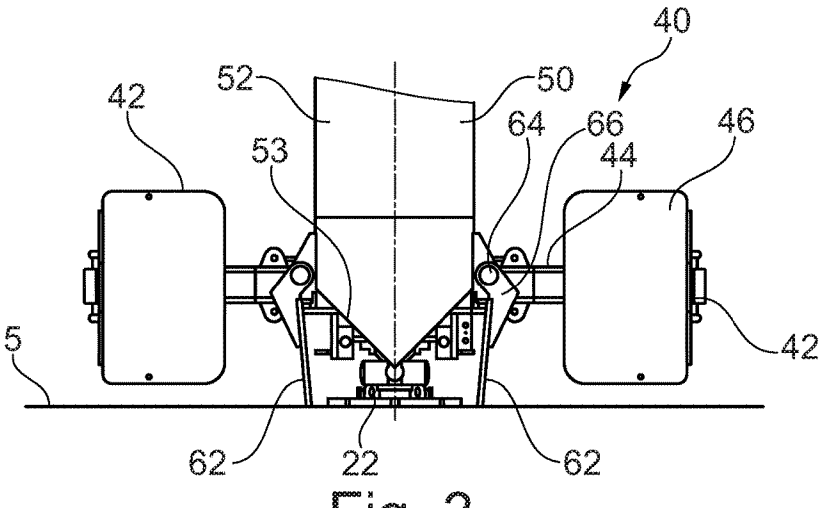
Figure 4:
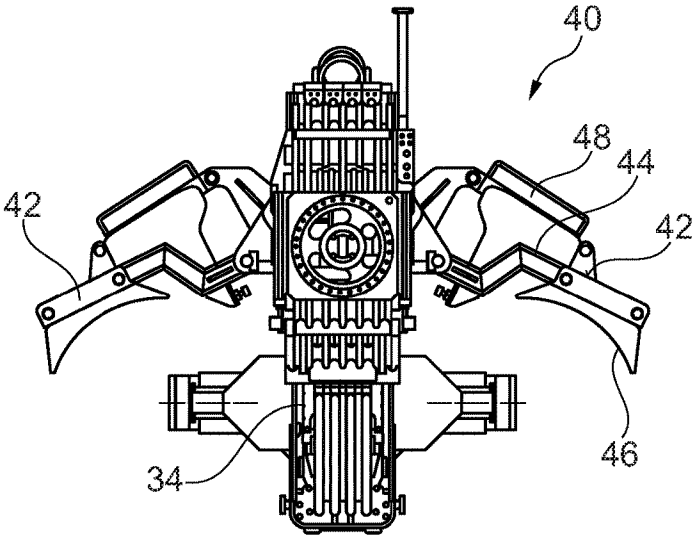

The invention is explained in greater detail below by means of a preferred exemplary embodiment which is shown schematically in the drawings. The drawings show in:

FIG. 1 a side view of a construction machine according to the invention;

FIG. 2 a front view of the displacement tube on the construction machine of FIG. 1;

FIG. 3 an enlarged detail view of the actuating unit in the open position on the construction machine in front view;

FIG. 4 a view of the actuating unit of FIG. 3 in a view from the top;

FIG. 5 a detailed view of the actuating unit of FIG. 3 in the closed position in front view; and FIG. 6 a view from above corresponding to FIG. 4 of the actuating unit in the closed position according to FIG. 5.

FIG. 1 shows a construction machine 10 according to the invention in an overall view. The construction machine 10 comprises a carrier apparatus 12 with an undercarriage 13 configured as a crawler chassis. An upper carriage 14 with an operator's cab 16 is mounted on the undercarriage 13, so as to be pivotable about a vertical axis of rotation. A control means for operating the construction machine 10 can be arranged in the operators cab 16.

A substantially vertical mast 20 is adjustably held on the upper carriage 14 via an adjustment mechanism 18. In the embodiment shown, the mast 20 is designed as a so-called telescopic frame leaders. On a front side of the mast 20, a working slide 32 is mounted along a linear guide to form a feed drive 30. A vibrator 34 is attached to the working slide 32, with which targeted vibrations can be generated by means of rotating unbalance units.

Via a clamping device 36 with collets 38, which are shown in FIG. 2, a displacement tube 50 with a tube base body 52 is clamped and held on the underside of the vibrator 34. Via the clamping device 36, feed forces as well as vibrations of the vibrator 34 can be transmitted from the feed drive 30 to the displacement tube 50. In this way, the displacement tube 50 is introducible into the ground 5 to form a hole therein while displacing ground material. Via a schematically indicated feed device 54 on the upper side of the displacement tube 50, a filling material for forming a filling material column can be introduced into the displacement tube 50 and thus into the ground 5.

A displacement tip 58 is provided at the lower end of the displacement tube 50, which is formed by a closure device 60 having two pivotable closure flaps 62. Via an actuating unit 40 at the lower end of the mast 20, the closure flaps 62 of the closure device 60 can be pressed against each other and thus moved and held in a closed position for forming the displacement tip 58.

An actuating unit 40 is arranged at the lower end of the mast 20. The operation of the actuating unit 40 according to the invention is explained in greater detail in conjunction with FIGS. 3 to 6. The actuating unit 40 comprises two pressing-on elements 42, which are formed substantially symmetrically with respect to a vertical center plane of the construction machine 10 with the mast 20. The two pressing-on elements 42 of the actuating unit 40 are thereby located opposite one other, wherein only one pressing-on element 42 of the otherwise functionally identically configured pressing-on elements 42 is explained below.

Each pressing element 42 has an approximately horizontally oriented actuating arm 44, which is pivotally mounted about a vertical axis at a lower end of the mast 20. The mast 20 can be supported directly on the ground 5 by a mast base 22. A curved pressure-on plate 46 is provided at the free end of the actuating arm 44, which is formed to press against a radially projecting actuating portion 44 of a closure flap 62. In the illustrated embodiment, two opposing closure flaps 62 are each supported by a pivot joint 64 at the lower end of the displacement tube 50 in order to form a penetration tip 58. A tapered abutment edge 53 is formed on a lower end of the tube base body 52 of the displacement tube 50, against which the closure flaps 62 can be pressed for forming the displacement tip 58.

FIG. 3 shows the closure device 60 with the two closure flaps 62 in an open position, with the pressing elements 42 spaced from the closure flaps 62 are in a retracted position, as can be clearly seen in the top view of FIG. 4. The top view of FIG. 4 shows the top of the vibrator 34, such that in this way the displacement tube 50 in FIG. 4 is hidden and not visible.

By actuating the actuating cylinders 48 on the pressing-on elements 42, which are in particular hydraulic cylinders, the actuating arms 44 are pivoted towards the displacement tube 52, as is illustrated clearly in FIGS. 5 and 6. In doing so, the shell-shaped pressure-on plates 46 press on the respective actuating portions 66 on the closure flaps 62. As a result, the closure flaps 62 are pivoted inwards about the respective horizontally directed pivot joint 64 from the open position into a closed position and pressed against the arrow-shaped abutment edge 53 on the tube base body 52. This forms the closed penetration tip 58 at the lower end of the displacement tube 50 in the closed position of the closure flaps 52.

In this position, a vertical force can now be exerted downward via the feed drive 30, pressing the displacement tube 50 into the ground 5 while forming a hole. By simultaneous operation of the vibrator 34, a quasi liquefaction of the ground 5 can be effected, so that a penetration of the displacement tube 50 is considerably simplified.

After reaching the final position, filling material can be introduced into the ground 5 via the hollow displacement tube 50, while at the same time the displacement tube 50 is retracted from the ground 5 again via the feed drive 30. During retraction, the closure flaps 62 are pressed into their open position by the filling material being present, which is shown in FIG. 3. This unblocks an outlet opening 46 at the lower end of the displacement tube 50.

The invention claimed is:

1. A construction machine for introducing a displacement tube into the ground, wherein the displacement tube comprises a tube base body and, at its lower end, a closure device which comprises at least one closure flap which is adjustable between a closed position, in which the displacement tube is closed downwards by the at least one closure flap and an open position in which filling material can exit from the displacement tube into the ground for forming a filling material column, wherein the construction machine comprises a feed drive for introducing and retracting the displacement tube into and out of the ground, respectively, wherein an actuating unit having at least one pressing-on element is arranged on the construction machine, by means of which the at least one closure flap is adjustable from the open position into its closed position and retainable in said position before contacting the ground at least until the closed closure flap penetrates into the ground.

2. The construction machine according to claim 1, wherein the feed drive can be moved vertically with the displacement tube along a mast, and the actuating unit is arranged at a lower end of the mast.

3. The construction machine according to claim 1, wherein the at least one pressing-on element has an actuating arm which is adjustable, in particular pivotable, between a pressing-on position for closing the closure flap and a retracted position in which the pressing-on element is spaced apart from the displacement tube and the at least one closure flap.

4. The construction machine according to claim 3, wherein a pressure-on plate is attached to a free end of the actuating arm.

5. The construction machine according to claim 1, wherein the displacement tube comprises two closure flaps, and the actuating unit correspondingly comprises two pressing-on elements, each of which is assigned to a closure flap.

6. The construction machine according to claim 5, wherein the pressure-on plates of the two pressing-on elements are arcuate and are designed for abutting and guiding the displacement tube during further introduction into the ground.

7. The construction machine according to claim 1, wherein a control means is provided by which the at least one pressing-on element is actuatable towards the at least one closure flap for closing the displacement tube before the at least one closure flap penetrates into the ground.

8. A displacement tube for creating a filling material column in the ground, wherein the displacement tube is introducible into the ground by means of a construction machine according to claim 1, and the displacement tube comprises a tube base body and, at its lower end, a closure device which comprises at least one closure flap which is adjustable between a closed position, in which the displacement tube is closed downwards by the at least one closure flap, and an open position, in which filling material can exit from the displacement tube into the ground for forming a filling material column, wherein the at least one closure flap is pivotably hinged to an outer side of the tube base body by means of a pivot joint, wherein a radially projecting actuating portion is formed on an outer side of the at least one closure flap, which portion can be brought into engagement with a pressing-on element of an actuating unit of the construction machine, wherein the closure flap can be pressed from the open position into the closed position by contact with the actuating portion, and the actuating portion is formed on the closure flap in such a way that the actuating portion projects radially outwards with respect to the pivot joint both in the open position and in the closed position.

9. The displacement tube according to claim 8, wherein the closure device comprises two closure flaps which are supported on the tube base body.

10. The displacement tube according to claim 8, wherein a feed device for feeding the filling material is arranged at an upper end of the tube base body.

11. A method for creating a filling material column in the ground, with a construction machine according to claim 1, in which a displacement tube having a closure device with at least one closure flap is introduced into the ground, which flap is in a closed position during introduction, and when a final depth is reached, the at least one closure flap is pivoted from the closed position into an open position, wherein filling material for forming a filling material column is introduced into the ground through an outlet opening, wherein by means of the actuating unit arranged on the construction machine, the at least one closure flap is pressed-on by least one pressing-on element before a displacing contacting of the closure flap with the ground, wherein the at least one closure flap is adjusted from the open position into the closed position.

12. The method according to claim 11, wherein the at least one pressing-on element abuts the at least one closure flap until the latter penetrates into the ground, and subsequently the at least one pressing-on element is retracted from the closure flap again.

13. The method according to claim 11, wherein the displacement tube is retracted from the ground again, and during a retraction movement of the displacement tube, the at least one closure flap is adjusted into the open position.

* * * * *